US006252476B1

(12) United States Patent
Maloratsky

(10) Patent No.: US 6,252,476 B1
(45) Date of Patent: Jun. 26, 2001

(54) MICROSTRIP RESONATORS AND COUPLED LINE BANDPASS FILTERS USING SAME

(75) Inventor: Leo G. Maloratsky, Indialantic, FL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/552,326

(22) Filed: Apr. 19, 2000

(51) Int. Cl.[7] ..... H01P 1/203

(52) U.S. Cl. ..... 333/204; 333/202

(58) Field of Search ..... 333/204, 202

(56) References Cited

U.S. PATENT DOCUMENTS

| | | | | |
|---|---|---|---|---|
| 2,606,974 | | 8/1952 | Wheeler | 333/115 |
| 5,021,757 | * | 6/1991 | Kobayashi et al. | 333/205 |
| 5,900,308 | | 5/1999 | Koike et al. | 428/209 |
| 5,990,765 | * | 11/1999 | Mansour et al. | 333/204 |

FOREIGN PATENT DOCUMENTS

| | | | | |
|---|---|---|---|---|
| 1283877 | * | 9/1985 | (SU) | 333/204 |

OTHER PUBLICATIONS

Matthaei, G. L., Young, L., Jones, E. M. T., "Microwave Filters, Impedance–Matching Networks, and Coupling Structures", 1964.

* cited by examiner

*Primary Examiner*—Benny Lee
*Assistant Examiner*—Stephen E. Jones
(74) *Attorney, Agent, or Firm*—Nathan O. Jensen; Kyle Eppele; James P. O'Shaughnessy

(57) ABSTRACT

Disclosed are microstrip resonators and bandpass filters using the same. The bandpass filters of the present invention include an input, an output and multiple resonators coupled between the input and the output. A first resonator coupled in series between the input and the output includes a first line conductor having first and second ends and a second line conductor having first and second ends. The first and second line conductors are positioned relative to one another such that the second end of the first line conductor is connected to the second end of the second line conductor, forming a first angle of the first resonator between the first and second line conductors. The first angle of the first resonator is substantially less than 180 degrees so that a physical length of the resonator, taken in a direction from the input to the output, is less than an electrical length of the first resonator. The first open ended line conductor connected to the second ends of the first and second line conductors at the point where the resonator is bent. The length of the open ended line conductor is equal to a guided quarter-wavelength of a second (or third, etc.) harmonic of a center frequency of a passband of the filter. The bandpass filter of the present invention exhibits better attenuation for second and higher harmonics.

13 Claims, 5 Drawing Sheets

MICROSTRIP RESONATORS AND COUPLED LINE BANDPASS FILTERS USING SAME

FIELD OF THE INVENTION

The present invention relates generally to microstrip line filters which are used, for example, in miniature receivers and transmitters. More particularly, the present invention relates to microstrip preselectors.

BACKGROUND OF THE INVENTION

Bandpass filters are two-port networks that provide transmission at frequencies within the passband of the filter and attenuation of other frequencies outside of the band. Microstrip bandpass filters are small in size and easy to fabricate. Microstrip coupled line bandpass filters comprise a cascade of parallel half-wavelength-long printed resonators open-circuited at both ends. The resonators are positioned parallel to each other, in such a way that adjacent resonators are coupled along the length equal to the guided quarter-wavelength of the center frequency of the filter.

Disadvantages of conventional microstrip bandpass filters include the existence of a spurious mode which occurs at nearly twice the passband frequency. The spurious mode is caused by the different even-mode and odd-mode propagation velocities of the coupled microstrip resonators. Other disadvantages of these conventional microstrip filters are radiation from open ends, and difficulty obtaining a narrow passband. Also, as with many microelectronic circuit components, the required physical size of conventional microstrip bandpass filters is a limitation to circuit miniaturization.

SUMMARY OF THE INVENTION

Disclosed are microstrip bandpass filters. The bandpass filters of the present invention include an input, an output and multiple resonators coupled between the input and the output. A first resonator coupled in series between the input and the output includes a first line conductor having first and second ends and a second line conductor having first and second ends. The first and second line conductors are positioned relative to one another such that the second end of the first line conductor is connected to the second end of the second line conductor, forming a first angle of the first resonator between the first and second line conductors. The first angle of the first resonator is substantially less than 180 degrees so that a physical length of the resonator, taken in a direction from the input to the output, is less than an electrical length of the first resonator. The open ended line is connected to the remainder of the resonator at the point where the resonator is bent.

DETAILED DESCRIPTION OF AN ILLUSTRATIVE EMBODIMENT

Figure 1:
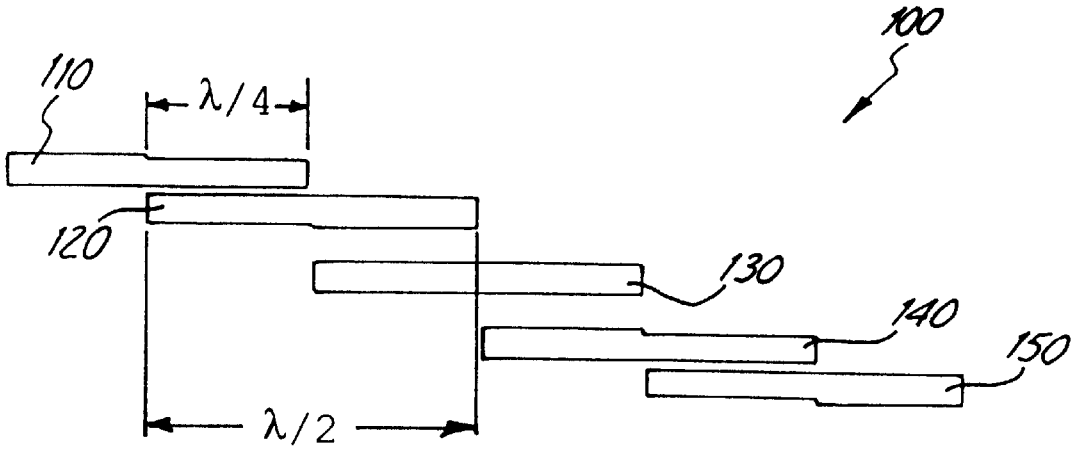
Fig. 1 PRIOR ART
FIG. 1 illustrates a prior art microstrip coupled line bandpass filter.

Referring now to the drawings, FIG. 1 illustrates a prior art microstrip coupled line bandpass filter 100. As shown in FIG. 1, filter 100 includes multiple line conductors (line conductors 110, 120, 130, 140, and 150 are illustrated). The line conductors which make up the microstrip filter are generally linear in shape and are coupled in a parallel fashion with end conductors 110 and 150 forming the input and output, respectively, of filter 100. Each line conductor is of length $\lambda/2$, and the line conductors are coupled a long a length equal to $\lambda/4$, where $\lambda$ is the center guided wave-length at the microstrip coupled lines.

Figure 2:
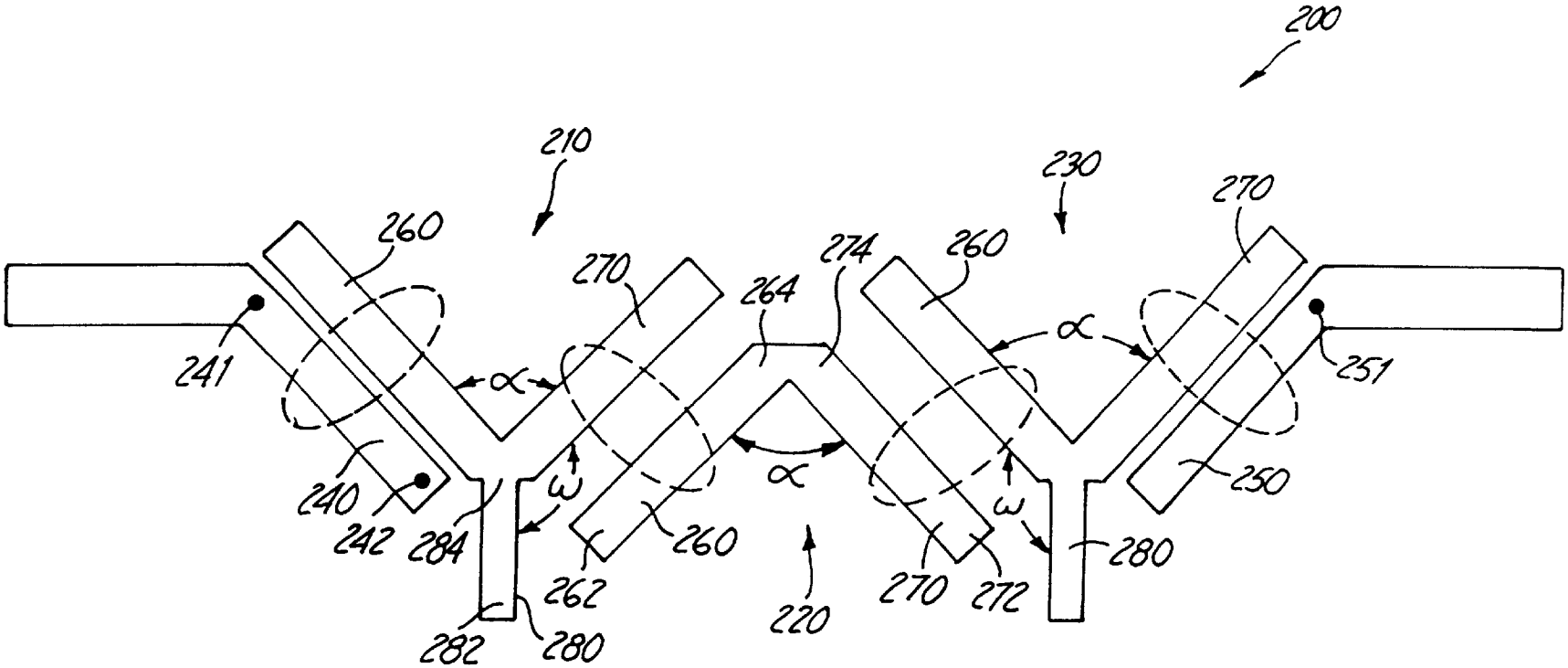
FIG. 2 illustrates one embodiment of the wiggly coupled line bandpass filters of the invention.

FIG. 2 illustrates microstrip wiggly bandpass filter 200 of the present invention. In the exemplary embodiment illustrated in FIG. 2, filter 200 includes microstrip resonators 210, 220 and 230 deposited on a substrate and positioned between input 241 and output 251. While the embodiment in FIG. 2 is shown with three resonators, various other embodiments may contain more or fewer resonators in different arrangements.

In illustrative embodiments, the resonators of the present invention can include resonators with additional open ended lines 280, such as resonators 210 and 230, as well as resonator 220 without an additional open ended line. Resonator embodiments other than those shown can include open ended lines 280. Each resonator includes a first line conductor 260 and a second line conductor 270. Each line conductor 260 has first and second ends 262 and 264, respectively. Likewise, each of second line conductors 270 includes first and second ends 272 and 274, respectively. Within each resonator, second end 264 of first line conductor 260 is connected to second end 274 of second line conductor 270 such that first and second line conductors 260 and 270 form an angle $\alpha$.

In addition to line conductors 260 and 270, open ended resonators 210 and 230 include an open ended line 280. Each open ended line 280 has a first end 282 and a second end 284, with second end 284 connected to second ends 264 and 274 of line conductors 260 and 270. Thus, within the resonators, open ended line 280 is connected to the remainder of the resonator at the point where the resonator is bent.

Generally, the banding angle $\alpha$ between line conductors 260 and 270 will be substantially less than 180° in order to reduce the overall physical length of filter 200 between input 241 and output 251. While angle $\alpha$ can be any manufacturable angle which is substantially less than 180°, in many embodiments angle $\alpha$ will be between approximately 25° and approximately 100°. Angles smaller than 25° are more difficult to implement, while angles larger than 100° do not provide as great of length reduction benefit for filter 200. Nevertheless, angle $\alpha$ can be less than 25° or greater than 100° if desired.

In some embodiments of open ended resonators 210 and 230, angles $\omega$ are formed between open ended line 280 and each of first and second line conductors 260 and 270. Because angle $\alpha$ will typically have a value which is substantially less than 180°, in some embodiments angles $\omega$ will be substantially greater than 90°. However, other values for angle $\omega$ are possible.

Generally, within each resonator, the physical length of first line conductor 260 is no more than slightly different from the physical length of second line conductor 270 because the guided wavelength of microstrip coupled lines depends on the width and spacing between the coupled lines. The overall physical length of each resonator, which is the combined length of first and second line conductors 260 and 270, will be equal to the guided half-wavelength of the central frequency of the bandpass filter. Each of line conductors 260 and 270 within a resonator will have a length of approximately one-quarter of the guided wavelength of the central frequency of the bandpass filter. The portion of input conductor 240 which is positioned parallel and adjacent to line conductor 260 of resonator 210, and the portion of output conductor 250 which is positioned parallel and adjacent to line conductor 270 of resonator 230, will also have a length of approximately one-quarter of the guided wavelength of the central frequency of the bandpass filter.

The length of an open ended line 280 may vary depending on the characteristics required. In some embodiments, the open ended lines 280 are formed to have a physical length equal to the guided quarter-wavelength of the second harmonic of an input signal in order to create good attenuation at the second harmonic of the input signal. Good attenuation of the third harmonic can be realized if the electrical length of an open ended line 280 is equal to the guided quarter-wavelength of the third harmonic of the input signal.

In embodiments of the present invention which include two or more open ended resonators such as resonators 210 and 230, the open ended lines 280 can be constructed of assorted lengths to be used in the adjustment of filter frequency response. The open ended lines 280 do not significantly increase main signal loss because open ended line input impedance is very high for the main frequency signal. Also, open ended lines 280 are located at the minimum electromagnetic field position of the resonators.

In the embodiment illustrated in FIG. 2, for conductor line 240 coupled to line conductor 260, the electrical phase $\psi_1$ of the signal in the opened end 242, and the phase of the radiation signal $\psi_{1rad}$ from the opened end 242, relative to the input 241, is calculated as follows:

$$\varphi_1 = \varphi_{1\mathrm{rad}} = arctg\,\frac{2Z\sin\Theta_1\cos\Theta_1}{\cos^2\Theta_1 - Z\sin^2\Theta_1} - \frac{\pi}{2}$$

where,

Z=normalized impedance of line 240;

$$\Theta_1 = \frac{2\pi l_1}{\lambda} = \text{electrical length of line 240;}$$

and $l_1$=physical length of line 240

The electrical length $\Theta_1$ of the quarter-wavelength input conductor 240 is equal to $\pi/2$, therefore making $\psi_1=\psi_{1rad}=-\pi/2$. For conductor line 260 of resonator 220 , the electrical phase $\psi_2$ of the signal in the open end 262 following is:

$$\psi_2=\psi_1=-\pi/2$$

However, the phase of the radiation signal is equal to $\psi_{2rad}=-\psi_2-\psi_{1rad}$. Therefore, resonators that contain open ended lines reduce free-space radiation due to the phase cancellation of fields at the ends 242 and 262.

The total physical length of microstrip wiggly coupled line filter 200 is approximately 20 percent less than conventional coupled line filters because the half-wavelength of the resonators which contain open ended lines are banded. As discussed above, length reduction depends on the banding angle $\alpha$.

Figure 3A:
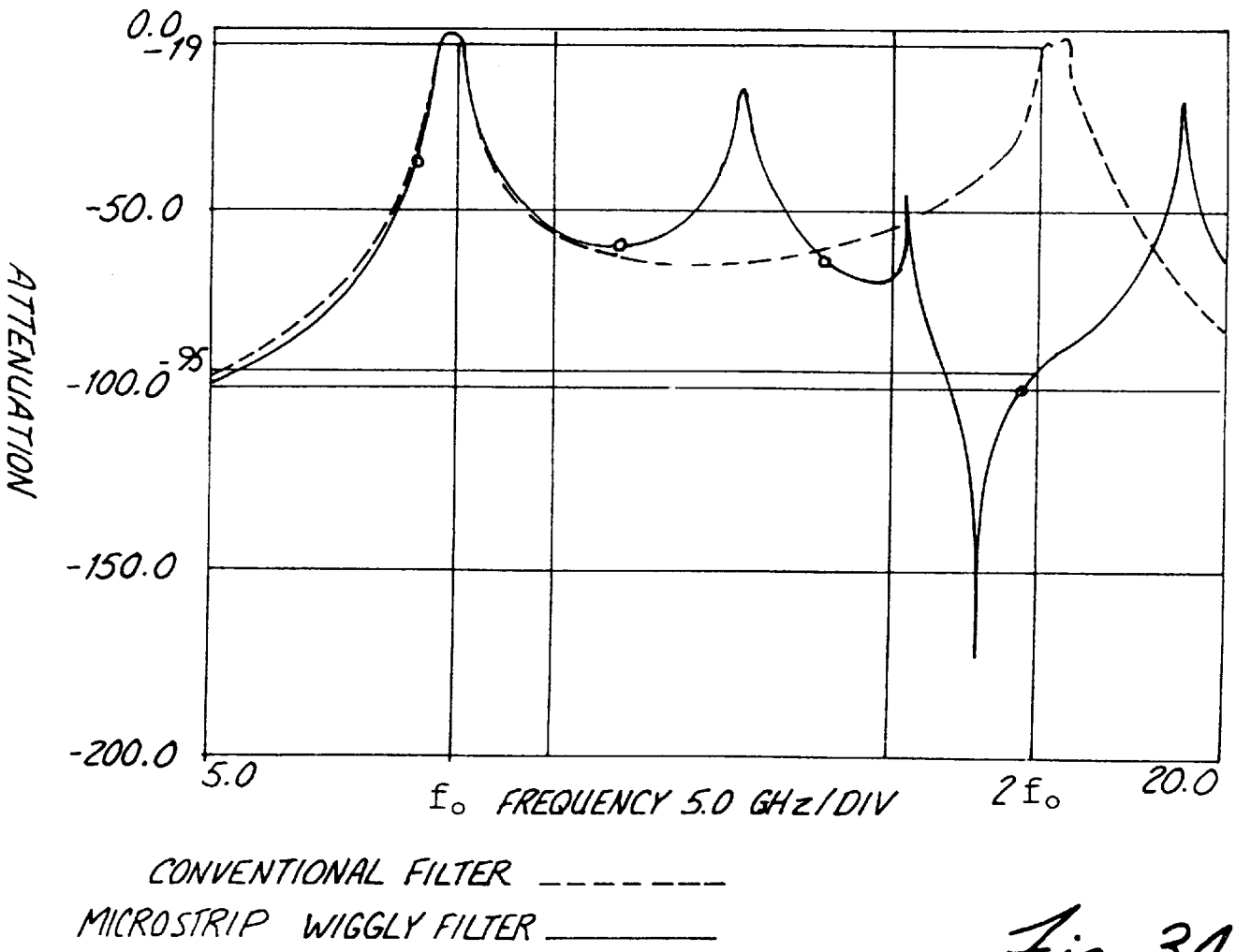
FIGS. 3A and 3B illustrate simulated frequency characteristics for the microstrip wiggly coupled line bandpass filters of the present invention and for a conventional prior art microstrip bandpass filter.
Figure 3B:
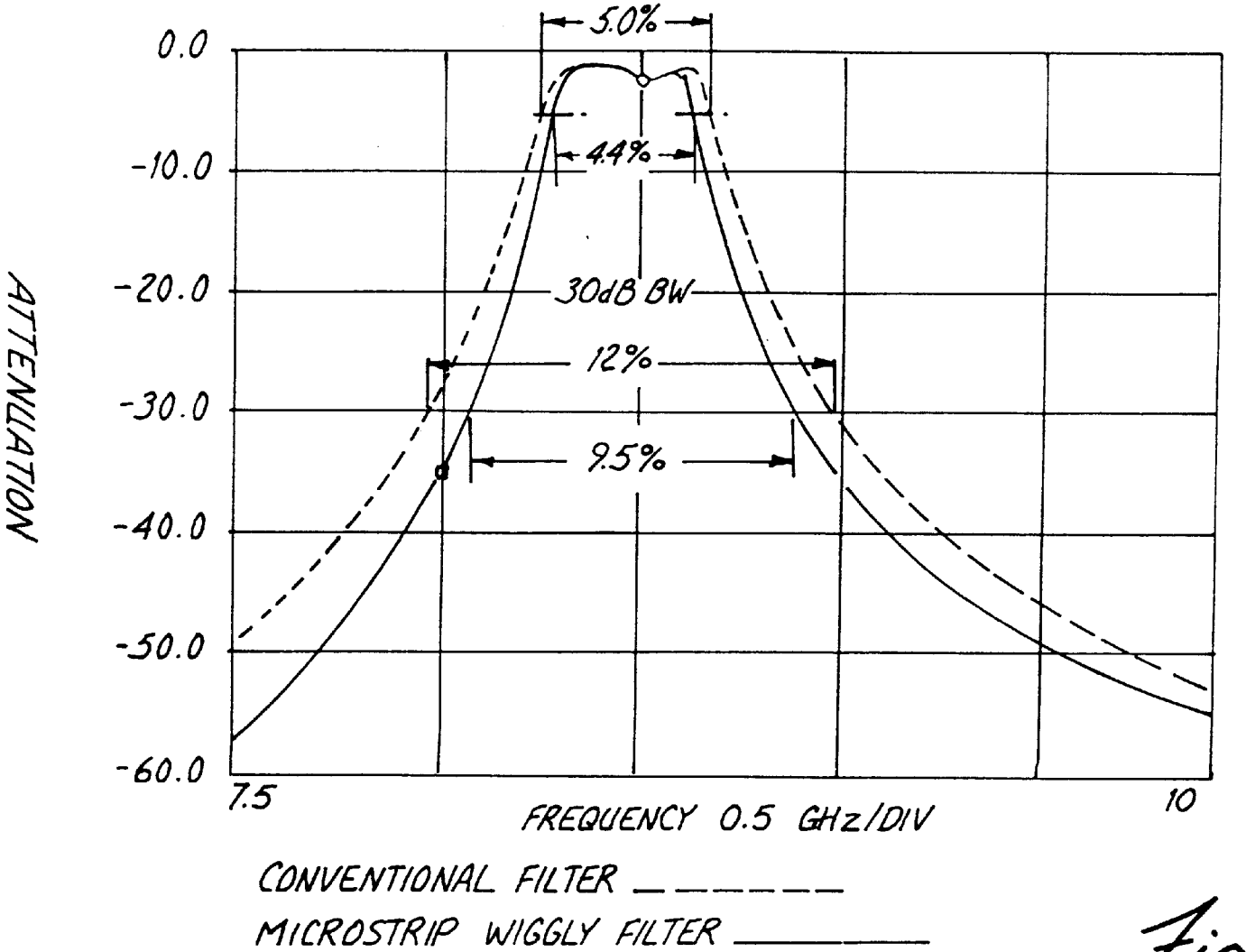

FIGS. 3A and 3B illustrate simulated frequency responses of the microstrip wiggly coupled line four-pole bandpass filter illustrated in FIG. 2 as compared to a conventional microstrip four-pole bandpass filter. The simulated data for the microstrip wiggly filter is signified with a solid line, while the conventional filter data is identified with a dashed line. As illustrated in FIG. 3A, microstrip wiggly coupled line bandpass filter 200 provides significantly improved second harmonic $2f_o$ attenuation for an input signal. Attenuation for the second harmonic $2f_o$ of an input signal having a frequency $f_o$ is calculated to be 95 dB, where the conventional filter provides second harmonic attenuation of only 3.9 dB. Bandpass losses for the microstrip wiggly filter are less than 2 dB as can be seen in FIG. 3B. The 30 dB attenuation level of the microstrip wiggly filter is 9.5 percent, as compared to 12 percent in the conventional filter. The 3 dB level is 4.4 percent using the filter of the invention, as compared to 5.0 percent for the conventional filter.

Figure 4:
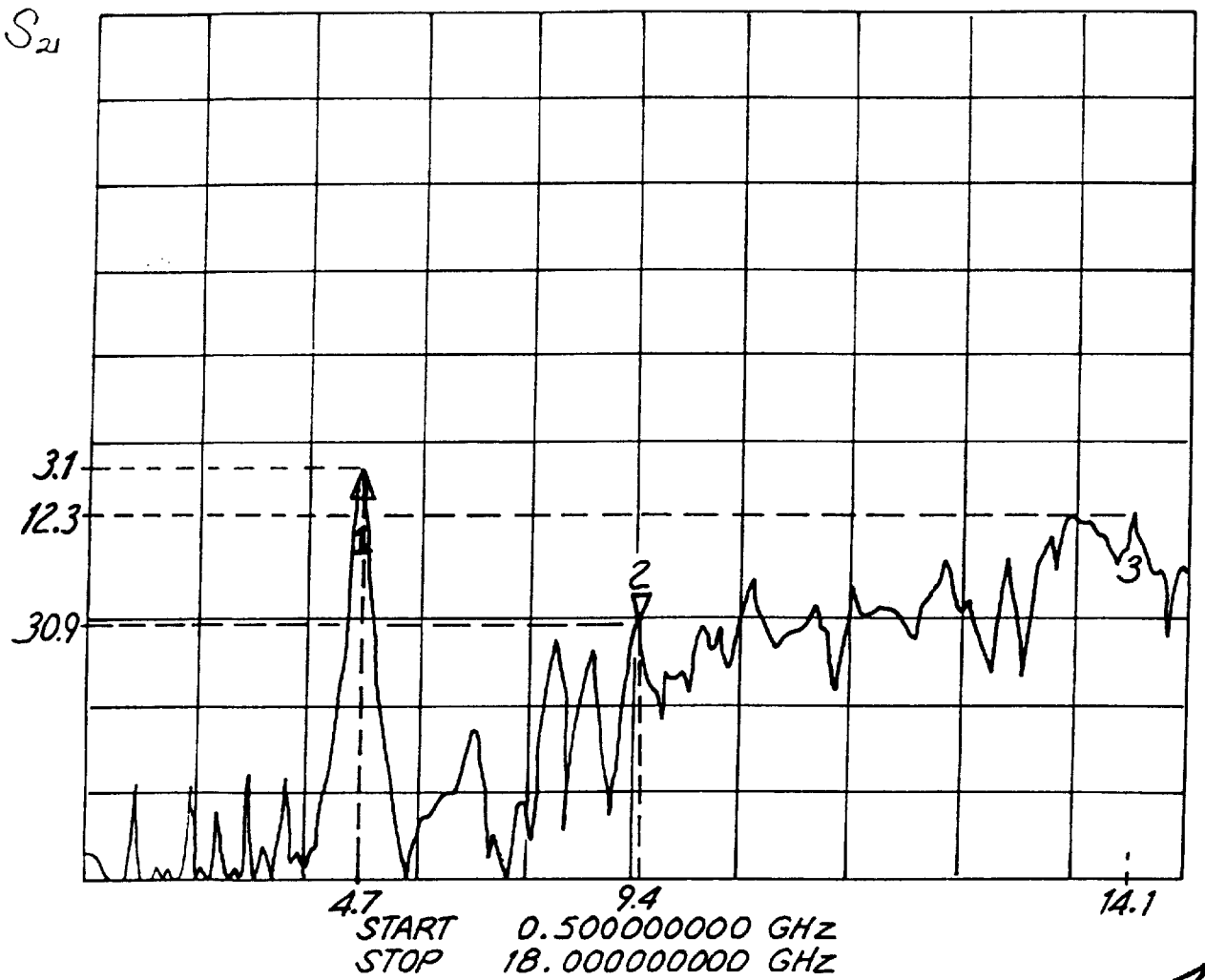
FIG. 4 illustrates experimental frequency characteristic results for the microstrip wiggly coupled line bandpass filters of the present invention.

Experimental results of the microstrip coupled line four-pole filter are shown in FIG. 4. The substrate on which the filter was deposited for these experiments was Duroid 5880, which had a 0.030 inch thickness and a dielectric constant of 2.2. Measurements of filter performance indicate that attenuation at the second and third harmonics was 30.9 dB and 12.3 dB, respectively. These experimental results confirmed that the wiggly coupled line bandpass filters of the invention exhibit better attenuation for second and higher harmonics while providing better rejection and a shorter length dimension than the same parameters in conventional coupled line bandpass filters.

Although the present invention has been described with reference to preferred embodiments, workers skilled in the art will recognize that changes may be made in form and detail without departing from the spirit and scope of the invention.

What is claimed is:

1. A microstrip bandpass filter comprising:

an input;

an output; and a plurality of resonators coupled in series between the input and output each resonator comprising:

a first line conductor having first and second ends; and a second line conductor having first and second ends, the first and second line conductors of each resonator positioned such that the second end of the first line conductor is connected to the second end of the second line conductor to form a first angle of each resonator which is substantially less than 180 degrees;

wherein at least one of the plurality of resonators further comprise an open ended line conductor connected to the second ends of the first and second line conductors, the open ended line conductor and the first line conductor forming a second angle of each open ended resonator, the open ended line conductor and the second line conductor forming a third angle of each open ended resonator, with the second and third angles of each open ended resonator being substantially greater than 90 degrees.

2. A microstrip bandpass filter comprising:

an input;

an output coupled in series with the input; and a first resonator coupled in series between the input and output the first resonator comprising:

a first line conductor having first and second ends; and a second line conductor having first and second ends, the first and second line conductors Positioned relative to one another such that the second end of the first line conductor is connected to the second end of the second line conductor, forming a first angle of the first resonator between the first and second line conductors, the first angle of the first resonator being substantially less than 180 degrees;

wherein the first resonator further comprises a first open ended line conductor connected to the second ends of the first and second line conductors, the first open ended line conductor and the first line conductor forming a second angle of the first resonator, the first open ended line conductor and the second line conductor forming a third angle of the first resonator, the second and third angles of the first resonator being substantially greater than 90 degrees.

3. The microstrip bandpass filter of claim 2, wherein the bandpass filter further comprises a second resonator coupled in series between the input and output, the second resonator comprising:

a third line conductor having first and second ends; and a fourth line conductor having first and second ends, the third and fourth line conductors positioned relative to one another such that the second end of the third line conductor is connected to the second end of the fourth line conductor, forming a first angle of the second resonator between the first and second line conductors, the first angle of the second resonator being substantially less than 180 degrees.

4. The microstrip bandpass filter of claim 3, wherein the second resonator further comprises a second open ended line conductor connected to the second ends of the third and fourth line conductors, the second open ended line conductor and the third line conductor forming a second angle of the second resonator, the second open ended line conductor and the fourth line conductor forming a third angle of the second resonator, the second and third angles of the second resonator being substantially greater than 90 degrees.

5. The microstrip bandpass filter of claim 3, wherein the first and second resonators are positioned such that the third line conductor is adjacent and parallel to the second line conductor, thereby electromagnetic coupling the first and second resonators.

6. The microstrip bandpass filter of claim 5, wherein the bandpass filter further comprises a third resonator coupled in series between the input and output, the third resonator comprising:

a fifth line conductor having first and second ends;

a sixth line conductor having first and second ends, the fifth and sixth line conductors positioned relative to one another such that the second end of the fifth line conductor is connected to the second end of the sixth line conductor, forming a first angle of the third resonator between the fifth and sixth line conductors, the first angle of the third resonator being substantially less than 180 degrees; and a second open ended line conductor connected to the second ends of the fifth and sixth line conductors, the second open ended line conductor and the fifth line conductor forming a second angle of the third resonator, the second open ended line conductor and the sixth line conductor forming a third angle of the third resonator, the second and third angles of the third resonator being substantially greater than 90 degrees.

7. The microstrip bandpass filter of claim 6, wherein the second and third resonators are positioned such that the fifth line conductor is adjacent and parallel to the fourth line conductor, thereby electromagnetic coupling the second and third resonators.

8. The microstrip bandpass filter of claim 7, wherein an input conductor is positioned relative to the first resonator such that it is adjacent and parallel to the first line conductor and an output conductor is positioned relative to the third resonator such that it is adjacent and parallel to the sixth line conductor.

9. The microstrip bandpass filter of claim 7, wherein an input conductor is positioned relative to the first resonator such that it is adjacent and parallel to the first line conductor, and wherein the input conductor and the first line conductor have lengths which are substantially equal to a guided quarter-wavelength of a center frequency of a passband of the filter, and an output conductor is positioned relative to the third resonator such that it is adjacent and parallel to the sixth line conductor, and wherein the output conductor and the sixth line conductor have lengths which are substantially equal to a guided quarter-wavelength of a center frequency of a passband of the filter.

10. The microstrip bandpass filter of claim 7, wherein a sum of the lengths of the first and second line conductors, a sum of the lengths of the third and fourth line conductors, and a sum of the lengths of the fifth and sixth line conductors are substantially equal to a guided half-wavelength of the center frequency of a passband of the filter.

11. The microstrip bandpass filter of claim 7, wherein the length of the open ended line conductors of the first and third resonators are equal to a guided quarter-wavelength of a second harmonic of a center frequency of a passband of the filter.

12. The microstrip bandpass filter of claim 7, wherein the length of the open ended line conductors of the first and third resonators are equal to a guided quarter-wavelength of a third harmonic of a center frequency of a passband of the filter.

13. The microstrip bandpass filter of claim 7, wherein the lengths of the open ended line conductors of the first and third resonators differ from one another.

* * * * *